US006535771B1

(12) United States Patent
Kussel

(10) Patent No.: US 6,535,771 B1
(45) Date of Patent: Mar. 18, 2003

(54) EXTRACTION CONTROLLER FOR MINING—EXTRACTION MACHINES

(75) Inventor: Willy Kussel, Werne (DE)

(73) Assignee: Tiefenbach Bergbautechnik GmbH, Essen (DE)

( * ) Notice: Subject to any disclaimer, the term of this patent is extended or adjusted under 35 U.S.C. 154(b) by 0 days.

(21) Appl. No.: 09/582,157

(22) PCT Filed: Oct. 22, 1999

(86) PCT No.: PCT/DE99/03398

§ 371 (c)(1),
(2), (4) Date: Aug. 14, 2000

(87) PCT Pub. No.: WO00/25003

PCT Pub. Date: May 4, 2000

(30) Foreign Application Priority Data

Oct. 23, 1998 (DE) ..... 198 49 134
Oct. 27, 1998 (DE) ..... 198 49 482

(51) Int. Cl.[7] ..... G05B 15/00
(52) U.S. Cl. ..... 700/83; 345/965
(58) Field of Search ..... 700/83, 15, 17, 700/9, 180, 275; 345/965, 961

(56) References Cited

U.S. PATENT DOCUMENTS 3,474,438 A * 10/1969 Lauher ..... 700/83
3,643,445 A 2/1972 Schmidt
4,228,508 A 10/1980 Benthaus
4,628,444 A * 12/1986 Nozawa et al. ..... 700/83
4,658,348 A * 4/1987 Flanagan et al. ..... 700/17
4,745,543 A * 5/1988 Michener et al. ..... 700/83
4,873,623 A * 10/1989 Lane et al. ..... 700/83
5,234,256 A 8/1993 Demircan et al.
5,420,978 A * 5/1995 Tozawa et al. ..... 700/83

FOREIGN PATENT DOCUMENTS

| | | |
|---|---|---|
| DE | 2 303 433 | 8/1974 |
| DE | 31 14 305 A1 | 11/1982 |
| DE | 42 02 246 A1 | 8/1992 |
| DE | 195 46 427 A1 | 8/1996 |
| GB | 2 254 640 A | 10/1992 |
| GB | 2 265 652 A | 10/1993 |

* cited by examiner

*Primary Examiner*—Ramesh Patel
*Assistant Examiner*—Edward F. Gain, Jr.
(74) *Attorney, Agent, or Firm*—Alston & Bird LLP

(57) ABSTRACT

A machine control system for a machine or plant controls a plurality of functions within an operating cycle. The start signals and stop signals for releasing and ending respectively the function can be preselected with respect to their mutual relative time slot by means of a data processor (computer) with a display screen. To this end, the functions of the machine or plant are listed in parallel lines on the display screen. Each of the functions can be represented in a graphic quantifying the duration of the function by inputting display screen signals with the limits, which correspond to the times of connection (start limit) and disconnection (stop limit) of the respective function. After starting up the operating cycle, the display screen signals are scanned by a switching signal, which advances in time in the direction from the start limit to the stop limit. The connection signal and disconnection signal, respectively are supplied to the machine control system, when the switching signal coincides with a display screen signal. The graphic of each function can be a bar diagram with bars, which are each associated to the functions, and the start and end of which mark the times of connection and disconnection of the respective function on a time axis parallel to the bars.

8 Claims, 1 Drawing Sheet

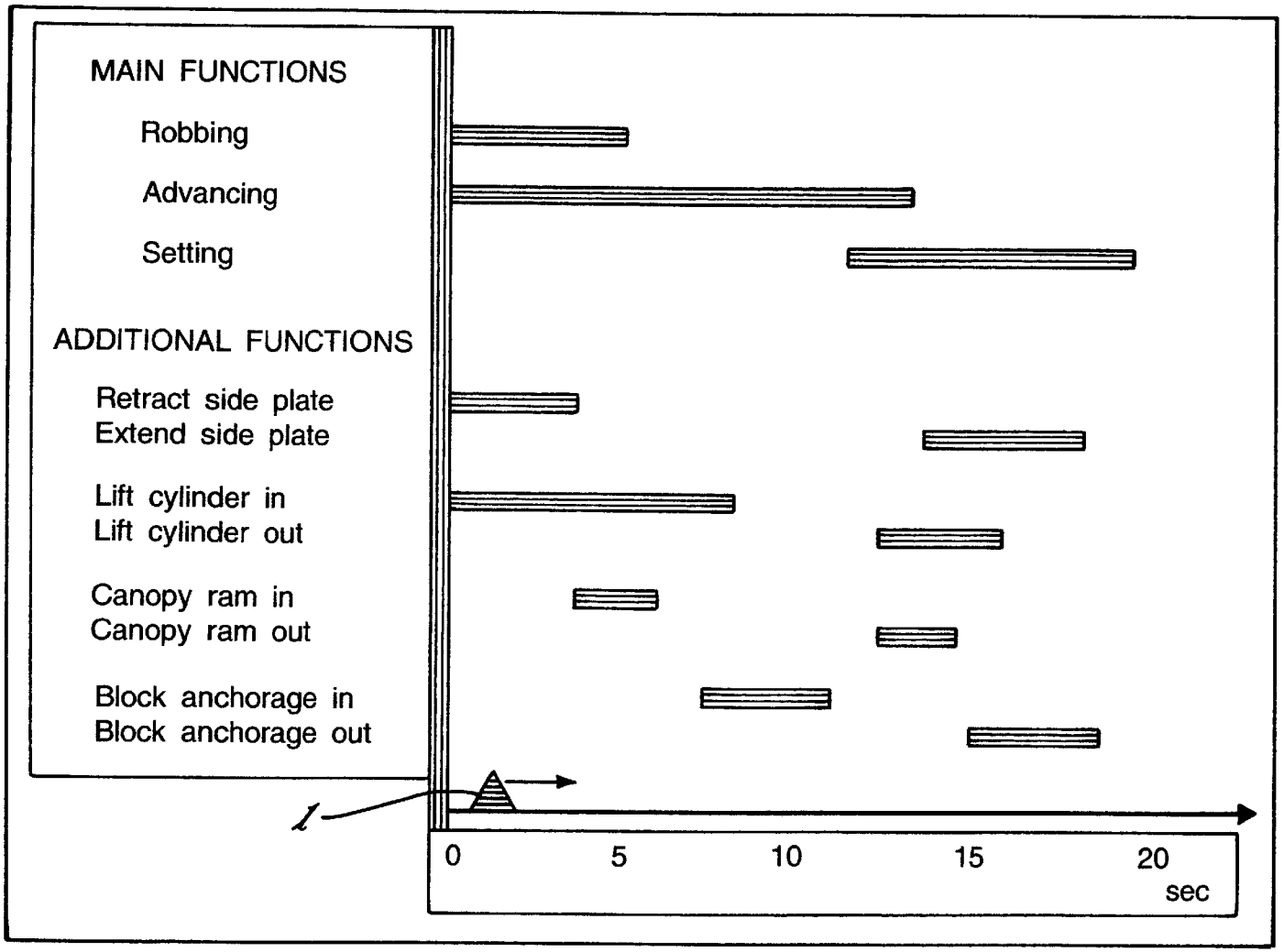
MAIN FUNCTIONS
Robbing
Advancing
Setting
ADDITIONAL FUNCTIONS
Retract side plate
Extend side plate
Lift cylinder in
Lift cylinder out
Canopy ram in
Canopy ram out
Block anchorage in
Block anchorage out
1
0
5
10
15
20
sec

EXTRACTION CONTROLLER FOR MINING— EXTRACTION MACHINES

BACKGROUND OF THE INVENTION

The present invention relates to a machine control system for a machine or plant with a plurality of functions controlled by start signals and stop signals, which are input by means of a data processor (computer) with a display screen.

A machine control system of this kind is generally known.

In this known control system, it is possible to release functions by hand, in that the data processor associated to the machine being controlled is caused, for example, by means of the keyboard of the control system, to release the start signal, so that the machine performs the particular function. In this connection, there are also machines which are capable of performing and intended to perform a plurality of functions at the same time, and/or successively, and/or with a time overlap.

When the machine is intended to perform a plurality of functions in a predetermined, chronological sequence, the start signals of the functions may also be released by a timing device of the data processor instead of by hand. In this instance, the timing device receives its input command for recording the time by the start signal or by the stop signal of another function that preceded in time.

The end of the function may again be released by hand. However, the data processor may also include a timing device which causes the stop signal of the function to be released after the lapse of a predetermined time, and which stops the function. It is possible to perform the time recording of even this timing device by the start of same, or by another function, or by the end of another function.

In general, the named timings are adjustable. In this connection, the enumeration of the possibilities of controlling the machine is by no means complete, but only by way of example.

In such a machine control system, there exists the risk that the unclearness of the existing functions leads to faulty switchings. Primarily, this applies to the event, when a plurality of functions is to be switched and run, that a function is missed, or that the relative, chronological switching points are wrongly selected and lead to a mutual interference of the functions.

SUMMARY OF THE INVENTION

In accordance with one aspect of the present invention, a control system in designed and constructed to operate in such a simple and transparent manner that the functions are safely preselected and switched in the correct sequence, at the right times, and with the right duration.

In accordance with one aspect of the present invention, the control system is for a machine or plant that performs a plurality of functions during an operating cycle, with each function being initiated by a start signal and ceased by a stop signal. In accordance with this aspect, the control system includes a computer and a display screen, and the computer is for performing the operations described below. The computer stores a plurality of display screen signals respectively corresponding to the functions. Each display screen signal includes starting and stopping limits, and the duration of the corresponding function is defined between the starting and stopping limits. The computer uses the display screen signals to graphically illustrate the functions and the duration of the functions on the display screen. Preferably the functions are graphically illustrated on the display screen in the form of parallel lines. The computer controls the operating cycle by causing a switching signal to advance in time in a direction that corresponds to the direction from the starting limit toward the stopping limit of each display screen signal. For each display screen signal, the computer provides the start signal for the corresponding function when the switching signal coincides with the starting limit, and the stop signal is provided for the corresponding function when the switching signal coincides with the stopping limit.

In accordance with one aspect of the present invention, the functions are graphically illustrated on the display screen in the form a bar diagram, with each bar of the bar diagram corresponding to a respective one of the functions and extending in the same direction as a time axis. The bars can be arranged in rows or columns. For each function, its corresponding bar has opposite ends that identify positions along the time axis that correspond to the starting and stopping limits of the screen signal for the function. The switching signal travels in the direction of the time axis and for each function the start signal is provided when the switching signal corresponds with one of the ends of the bar corresponding to the function, and the stop signal is provided when the switching signal corresponds with the other end of the bar corresponding to the function.

In accordance with one aspect of the present invention, the switching signal is illustrated on the display screen and travels in the direction of the time axis. For each function, the start signal is provided when the mark is aligned with one of the ends of the bar corresponding to the function, and the stop signal is provided when the mark corresponds with the other end of the bar corresponding to the function.

The present invention has as the advantage that it makes it possible to possible to predetermine the beginning or end, as well as the relative time slot of the functions, selectively by hand or by stored sequences and time durations.

The present invention can be used with special advantage in mining for rearranging longwall support devices, i.e., mining shields, since there the start of the rearrangement cycle is automatically predetermined, a large number of functions is to be switched, and since the chronological sequence of the individual functions relative to one another is to be preselected under difficult conditions.

BRIEF DESCRIPTION OF THE DRAWING

The FIGURE illustrates a display screen.

DETAILED DESCRIPTION OF AN EXEMPLARY EMBODIMENT

Referring to the FIGURE, the display screen lists vertically, one below the other, the functions during the backing, advancing, and positioning of a longwall support device (robbing, advancing, setting).

The operating cycle for running these functions is released, for example, by the mining machine as it is pulled along. The functions are previously selected with respect to their time sequence and duration (relative time slot), and they automatically run after releasing the operating cycle. To preselect the functions, bar diagrams are drawn on the display screen in the line of each function with the aid of a suitable character program by operating a keyboard or a mouse, before releasing the operating cycle, and they are stored as display screen signals in the data processor, for example, a PC.

By releasing the operating cycle, a corresponding program then associates a switching signal to each line. This switching signal synchronously scans with the other signals the line according to the time scale of the line length. When the switching signal coincides with one of the display screen signals, which defines the start or end of a bar diagram, the start or the end of the respective function will be released. Such a longwall support device with mining shields is described, for example in DE P42 02 246.0 and DE 195 46 427.3. The marking 1 represents the switching signal, which is synchronously associated to each line, and indicates the time advance, after the operating cycle is released.

As a result of drawing on the display screen all functions and all switching operations as bar diagrams, and the fact that the position and length of the bar diagrams in connection with the advancing speed of the switching signal illustrate and represent the time duration and relative time slot of the functions true to scale and in a clear manner, an operator receives the necessary assistance for the complete selection and preselection of all functions and the correct sequence of the operating cycle.

In this connection, the functions to be performed may have been previously stored in the data processor so that when called up on the display screen, they automatically appear on the display screen, for example, as a bar of a length proposed by the data processor, and that they are not missed. It will then be the duty of the operator to adjust the correct length and the relative position of the bars.

As can be noted, it is possible to control in this manner also machines which continuously perform a plurality of repeating functions. To this end, it will be necessary that as the time advances, the operator continuously supplement the display screen respectively with further functions or functions that are to be repeated, and with bars associated to same.

What is claimed is:

1. A control system for a machine or plant that performs a plurality of functions during an operating cycle, with each function being initiated by a preselected start signal and ceased by a stop signal, the control system comprising:

a display screen; and a computer for:

storing a plurality of display screen signals respectively corresponding to the functions, with each display screen signal including a starting limit and a stopping limit so that a duration of the corresponding function is defined between the starting limit and the stopping limit, using the display screen signals to graphically illustrate the duration of the functions on the display screen, and controlling the operating cycle by causing a switching signal to advance in time through the operating cycle and wherein for each display screen signal the controlling includes providing the start signal for the corresponding function when the switching signal coincides with the starting limit and providing the stop signal for the corresponding function when the switching signal coincides with the stopping limit.

2. A control system according to claim 1, wherein the functions are graphically illustrated on the display screen in the form of parallel lines.

3. A control system according to claim 1, wherein the functions are graphically illustrated on the display screen in the form a bar diagram, with each bar of the bar diagram corresponding to a respective one of the functions and extending in the same direction as a time axis, and for each function its corresponding bar has opposite ends that identify positions along the time axis that correspond to the starting and stopping limits of the screen signal for the function, and wherein the switching signal travels in the direction of the time axis and for each function the start signal is provided when the switching signal corresponds with one of the ends of the bar corresponding to the function and the stop signal is provided when the switching signal corresponds with the other end of the bar corresponding to the function.

4. A control system according to claim 3, wherein the bars are arranged in rows.

5. A control system according to claim 3, wherein the bars are arranged in columns.

6. A control system according to claim 1, wherein the switching signal is represented by a mark that is illustrated on the display screen and travels relative to the graphical illustrations of the functions that are displayed on the display screen.

7. A control system according to claim 3, wherein the switching signal is represented by a mark that is illustrated on the display screen and travels in the direction of the time axis, and for each function the start signal is provided when the mark corresponds with one of the ends of the bar corresponding to the function and the stop signal is provided when the mark corresponds with the other end of the bar corresponding to the function.

8. A control system according to claim 1, in combination with a plurality of longwall support devices, wherein the functions include robbing, advancing and setting.

* * * * *